US012221683B2

(12) United States Patent
Kubushiro et al.

(10) Patent No.: US 12,221,683 B2
(45) Date of Patent: Feb. 11, 2025

(54) TITANIUM ALUMINIDE ALLOY MATERIAL FOR HOT FORGING AND FORGING METHOD FOR TITANIUM ALUMINIDE ALLOY MATERIAL

(71) Applicants: IHI Corporation, Tokyo (JP); TOKYO INSTITUTE OF TECHNOLOGY, Tokyo (JP)

(72) Inventors: Keiji Kubushiro, Tokyo (JP); Yutaro Ota, Tokyo (JP); Shin Usui, Tokyo (JP); Masao Takeyama, Tokyo (JP); Hirotoyo Nakashima, Tokyo (JP)

(73) Assignees: IHI Corporation, Tokyo (JP); TOKYO INSTITUTE OF TECHNOLOGY, Tokyo (JP)

( * ) Notice: Subject to any disclaimer, the term of this patent is extended or adjusted under 35 U.S.C. 154(b) by 696 days.

(21) Appl. No.: 17/447,714

(22) Filed: Sep. 15, 2021

(65) Prior Publication Data

US 2022/0002854 A1 Jan. 6, 2022

Related U.S. Application Data

(63) Continuation of application No. PCT/JP2020/007907, filed on Feb. 27, 2020.

(30) Foreign Application Priority Data

Mar. 18, 2019 (JP) ..... 2019-049749

(51) Int. Cl.

| | |
|---|---|
| ***C22F 1/18*** | (2006.01) |
| ***B21J 5/00*** | (2006.01) |
| ***C22C 14/00*** | (2006.01) |

(52) U.S. Cl.

CPC ..... *C22F 1/183* (2013.01); *B21J 5/00* (2013.01); *C22C 14/00* (2013.01)

(58) Field of Classification Search

CPC ..... C22F 1/183; C22F 1/00; C22F 1/18; B21J 5/00; B21J 1/003; B21J 1/06; B21J 5/002; C22C 14/00

See application file for complete search history.

(56) References Cited

U.S. PATENT DOCUMENTS 6,425,964 B1 * 7/2002 Deevi ..... C22C 14/00 148/421

2010/0119402 A1 5/2010 Paul et al.

(Continued)

FOREIGN PATENT DOCUMENTS

EP 1 052 298 A1 11/2000

JP 06049689 A * 2/1994

(Continued)

OTHER PUBLICATIONS

International Search Report issued Jun. 2, 2020 in PCT/JP2020/007907 filed on Feb. 27, 2020, 3 pages.

(Continued)

*Primary Examiner* — John A Hevey

(74) *Attorney, Agent, or Firm* — Oblon, McClelland, Maier & Neustadt, L.L.P.

(57) ABSTRACT

A titanium aluminide alloy material for hot forging has a chemical composition including, by atom, aluminum of 38.0% or greater and 39.9% or less, niobium of 3.0% or greater and 5.0% or less, vanadium of 3.0% or greater and 4.0% or less, carbon of 0.05% or greater and 0.15% or less, and titanium and an inevitable impurity as a residue.

14 Claims, 3 Drawing Sheets

(56) References Cited

U.S. PATENT DOCUMENTS

| | | | | |
|---|---|---|---|---|
| 2018/0230576 | A1* | 8/2018 | Balsone | F01D 5/28 |
| 2019/0106778 | A1 | 4/2019 | Kubushiro et al. | |
| 2020/0362439 | A1 | 11/2020 | Kubushiro et al. | |
| 2021/0162497 | A1* | 6/2021 | Nakamura | C22C 1/0458 |

FOREIGN PATENT DOCUMENTS

| | | | |
|---|---|---|---|
| JP | 2000-345259 | A | 12/2000 |
| JP | 2002-356729 | A | 12/2002 |
| JP | 2008-184665 | A | 8/2008 |
| JP | 2010-532822 | A | 10/2010 |
| WO | WO 2018/043187 | A1 | 3/2018 |
| WO | WO 2019/123694 | A1 | 6/2019 |

OTHER PUBLICATIONS

Extended European Search report issued Oct. 10, 2022 in European Patent Application No. 20772555.7, 8 pages.

Fei, Y., et al., "Effect of Heat Treatment on Microstructure and Properties of as-Forged TiAl Alloy with beta Phase", Rare Metal Materials and Engineering, vol. 40, No. 9, Sep. 1, 2011, XP055486550, pp. 1505-1509.

Niu, H.Z., et al., "Producing fully-lamellar microstructure for wrought beta-gamma TiAl alloys without single alpha phase field", Intermetallics, Elsevier Science Publishers, vol. 59, Jan. 22, 2015, XP029197036, pp. 87-94.

* cited by examiner

TITANIUM ALUMINIDE ALLOY MATERIAL FOR HOT FORGING AND FORGING METHOD FOR TITANIUM ALUMINIDE ALLOY MATERIAL

CROSS REFERENCE TO RELATED APPLICATIONS

This application is a continuation application of International Application No. PCT/JP2020/007907, filed on Feb. 27, 2020, which claims priority to Japanese Patent Application No. 2019-049749, filed on Mar. 18, 2019, the entire contents of which are incorporated by reference herein.

BACKGROUND

1. Technical Field

The present disclosure relates to a titanium aluminide alloy material for hot forging and a forging method for a titanium aluminide alloy material.

2. Description of the Related Art

A titanium aluminide (TiAl) alloy is composed of an intermetallic compound including titanium (Ti) and aluminum (Al). The TiAl alloy has high heat resistance, and has a lighter weight and a higher specific strength than a Ni-based alloy, so as to be used for engine components for aircraft such as turbine blades. The TiAl alloy is, however, a material having low ductility and hard to process, and is thus subjected to isothermal forging as hot forging. JP 2002-356729 discloses a TiAl-based alloy including Al of 38% to 45% by atom and Mn of 3% to 10% by atom. JP 2002-356729 teaches that a TiAl-based material is heated and kept at a constant temperature, and is then forged while being cooled. JP 2008-184665 discloses a TiAl alloy including one or two or more of Nb, Mo, W and Ta, one or two or more of Cr, Mn and V, and Si. JP 2008-184665 teaches that a mixture balance of the components in the TiAl alloy is regulated so as to compensate for toughness that is decreased in association with the addition of the components for improving high-temperature creep properties.

SUMMARY

The processing by isothermal forging is executed for the metallic material by heating a metal die and the metallic material while keeping the temperature. The forging processing is typically executed at a low strain rate since a conventional TiAl alloy material has low processability, and thus has the disadvantage of low forging speed and low manufacturing efficiency and economic efficiency of products. To enhance the manufacturing efficiency of products to improve the economic efficiency, the TiAl alloy material needs to be improved in high-temperature forgeability to enable the forging processing at a high speed. A change made for the TiAl alloy material to enhance the forgeability generally decreases the strength of the TiAl alloy material. The forgeability of the TiAl alloy material is thus required to be improved without a decrease in strength so as to efficiently provide forged products of satisfactory quality using the TiAl alloy material.

An object of the present disclosure is to provide a titanium aluminide alloy material for hot forging having improved high-temperature forgeability while keeping high creep strength, and provide a forging method for the titanium aluminide alloy material so as to contribute to the spread of TiAl alloy products.

An aspect of the present disclosure provides a titanium aluminide alloy material for hot forging having a chemical composition including, by atom, aluminum of 38.0% or greater and 39.9% or less, niobium of 3.0% or greater and 5.0% or less, vanadium of 3.0% or greater and 4.0% or less, carbon of 0.05% or greater and 0.15% or less, and titanium and an inevitable impurity as a residue.

Another aspect of the present disclosure provides a titanium aluminide alloy material for hot forging having a chemical composition including, by atom, aluminum of 38.0% or greater and 39.9% or less, niobium of 3.0% or greater and 5.0% or less, vanadium of 3.0% or greater and 4.0% or less, carbon of 0.05% or greater and 0.15% or less, boron of 0.1% or greater and 0.2% or less, and titanium and an inevitable impurity as a residue.

An aspect of the present disclosure provides a hot forging method for a titanium aluminide alloy material including preparing the titanium aluminide alloy material for hot forging described above, and executing hot forging by setting a forging temperature within a range of a phase equilibrium temperature of either a β-phase or a (β+α) phase in a phase diagram of the titanium aluminide alloy material, and forging the titanium aluminide alloy material while keeping the set forging temperature in a non-oxidizing atmosphere.

The forging temperature in the hot forging is preferably set to 1150° C. or higher and 1300° C. or lower. A strain rate in the hot forging may be set to 0.1 per second or higher, or may be set to 1 per second or higher so as to execute high-speed forging.

The present disclosure can provide the titanium aluminide alloy material for hot forging with the processability upon hot forging improved while keeping the high creep strength, so as to enhance the efficiency of manufacturing titanium aluminide alloy products to contribute to the spread of the TiAl alloy material in association with the improvement in the economic efficiency.

DESCRIPTION OF THE EMBODIMENTS

A titanium aluminide (TiAl) alloy is an alloy material of TiAl (a γ-phase) or $Ti_3Al$ (an $\alpha_2$-phase), for example, which is an intermetallic compound including titanium (Ti) and aluminum (Al) The TiAl alloy is known as a material that can be subjected to hot processing by isothermal forging when a strain rate is low, but still needs to be improved in processability. It is particularly important to avoid a decrease in creep strength for the improvement of the TiAl alloy material, since heat resistance and high-temperature strength are essential material properties for the material using the TiAl alloy for components such as turbine blades. The improvement in forgeability of the TiAl alloy material is effective also in lowering a heating temperature upon isothermal forging to reduce a thermal load, so as to enable the application of general-purpose forging facilities.

The present disclosure provides a titanium aluminide alloy material for hot forging with the processability upon the hot forging improved while avoiding a decrease in creep strength of the TiAl alloy material, so as to keep the high creep strength and achieve the improvement in the processability of hot working. The present disclosure also provides a method of manufacturing a TiAl alloy material for hot forging (also referred to below as a TiAl alloy material for forging) and a method of forging the TiAl alloy material for hot forging. The improvement in the processability of hot working enables the isothermal forging executed at a higher speed, so as to effectively manufacture TiAl alloy products having high strength. This improves the economic efficiency of supplying products, and also contributes to the wide use of the TiAl alloy material. The improvement in the processability of hot working can also lower the temperature during the isothermal forging, so as to reduce a thermal load of a forging device and the like to allow general-purpose forging facilities to be used. The present disclosure can improve the efficiency of manufacturing TiAl alloy products accordingly.

An embodiment according to the present disclosure is described in detail below with reference to the drawings.

Figure 1:
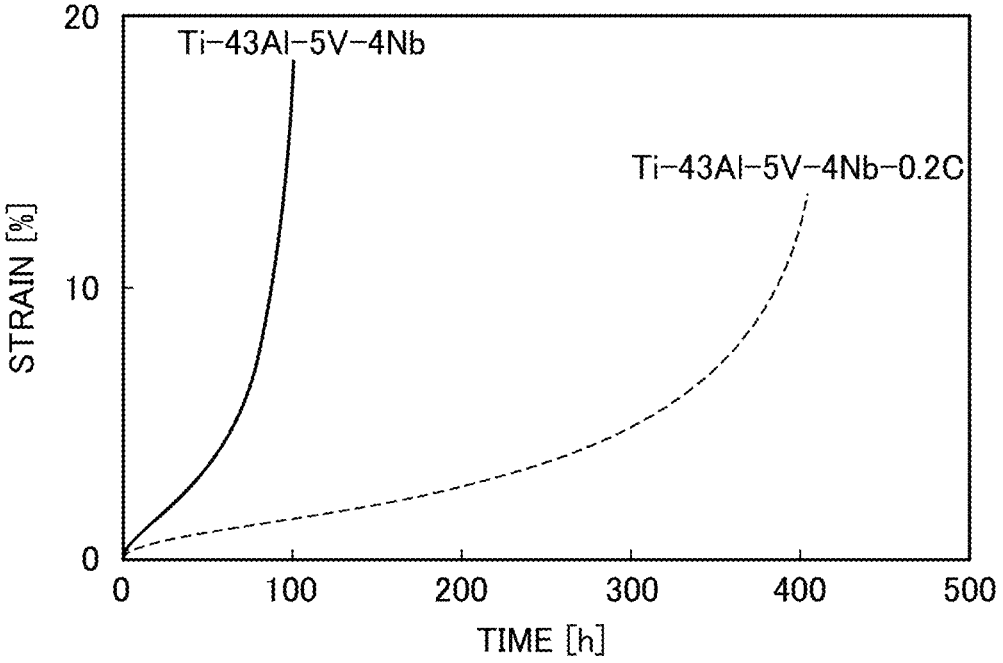
FIG. 1 is a graph showing a creep curve in a TiAl alloy material.

The element, carbon (C), which is one of various components added to a metallic material, is an effective component to harden the metallic material to improve the strength. Carbon also has the effect of enhancing the creep strength of the TiAl alloy material. This is apparent from the graph of FIG. 1 showing creep curves of the TiAl alloy material. FIG. 1 indicates a difference between the creep curves depending on the presence or absence of carbon in the TiAl alloy material based on a constitution of Ti-43% of Al-5% of V-4% of Nb (by atom). It is clear from FIG. 1 that the addition of carbon improves the creep strength of the TiAl alloy material.

Figure 2:
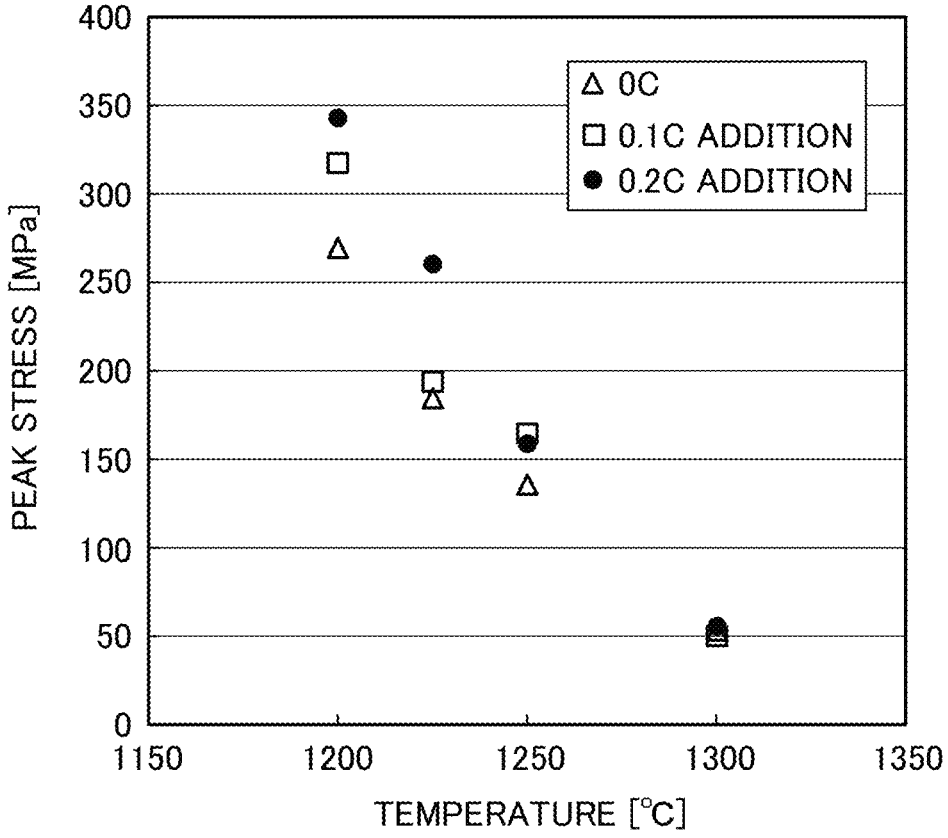
FIG. 2 is a graph showing a relationship between a temperature and a peak stress (a strain rate: 1/sec) in the TiAl alloy material.

At the same time, the addition of carbon decreases the forgeability of the TiAl alloy material. This is apparent from FIG. 2 that is a graph showing a relationship between a temperature and a peak stress of the TiAl alloy material. FIG. 2 shows results of measurement of the peak stress at a strain rate of one per second made for two kinds of the TiAl alloy materials shown in FIG. 1 and a TiAl alloy prepared to have a content of carbon present between the two TiAl alloy materials. According to FIG. 2, the increase in the content of carbon increases the peak stress, and the amount of carbon to be added is thus presumed to be preferably reduced in view of the improvement in the processability of hot working.

The present disclosure designs a chemical composition of the TiAl alloy to expand a region of a β-phase in a phase diagram toward a low temperature side so as to improve the processability of hot working of the TiAl alloy. This avoids a decrease in the processability of hot working caused by the addition of carbon, so as to provide the TiAl alloy material for hot forging achieving both the creep strength and the processability of hot working. The chemical composition of the TiAl alloy material for hot forging and the respective components included in the TiAl alloy material are described below.

A metallographic structure of titanium (Ti) shows an α-phase at a normal temperature, and shows a β-phase when heated to an allotropic modification temperature or higher. When Al is added as an alloying element to Ti, Al affects the α-phase (α-Ti) to be stabilized so as to cause a modification temperature of the alloy to increase. When other elements such as molybdenum (Mo), vanadium (V), niobium (Nb), iron (Fe), chromium (Cr), and nickel (Ni) are added to Ti, these elements affect the β-phase (β-Ti) to be stabilized so as to cause the modification temperature to decrease.

The titanium aluminide alloy material (the TiAl alloy material) for hot forging according to the present disclosure is based on the TiAl alloy mainly including Ti and Al, and includes β-phase stabilizing elements and carbon. The β-phase stabilizing elements as used herein are niobium (Nb) and vanadium (V). In particular, the TiAl alloy material preferably has a chemical composition including, by atom, aluminum of 38.0% or greater and 39.9% or less, niobium of 3.0% or greater and 5.0% or less, vanadium of 3.0% or greater and 4.0% or less, carbon of 0.05% or greater and 0.15% or less, and titanium and inevitable impurities as residues.

The TiAl alloy material for hot forging may further include boron (B) as necessary. The TiAl alloy material, when including boron, has a chemical composition including, by atom, aluminum of 38.0% or greater and 39.9% or less, niobium of 3.0% or greater and 5.0% or less, vanadium of 3.0% or greater and 4.0% or less, carbon of 0.05% or greater and 0.15% or less, boron of 0.1% or greater and 0.2% or less, and titanium and inevitable impurities as residues.

To expand the region of the β-phase toward the low temperature side in the phase diagram, the addition of the elements that stabilize the β-phase is effective, since the β-phase has the characteristics of being relatively soft and having high processability of hot working. The TiAl alloy material for hot forging according to the present disclosure is a material solidified from a molten state composed of the TiAl alloy including the elements that stabilize the β-phase, and has a chemical composition designed to lead the metallographic structure to include the β-phase at a target forging temperature. In addition, Al is an α-phase stabilizing element, and the content of Al is set to a low level upon the design of the chemical composition of the TiAl alloy so as to lead the β-phase stabilizing elements to function effectively. The TiAl alloy material for hot forging may further include boron (B), but the addition of boron is optional. The addition of boron micronizes crystalline grains in the metallographic structure, and enhances ductility of the TiAl alloy material at a high temperature. In view of this, boron can be added to the TiAl alloy material for hot forging as necessary with a content set to an appropriate range.

The TiAl alloy material for forging having the chemical composition described above, when heated so as to be led to a isothermal state for executing hot forging, is to include the β-phase in the metallographic structure. Since the β-phase has low high-temperature strength and is soft, the TiAl alloy material including the β-phase in the metallographic structure is easy to subject to forging processing. The TiAl alloy material thus can be subjected to the forging processing by isothermal forging at a strain rate of 0.1 per second or higher, or may be subjected to the forging processing at a forging speed corresponding to a strain rate of one per second or higher.

The content of aluminum (Al) in the TiAl alloy included in the TiAl alloy material for hot forging according to the present disclosure is set to 38.0% by atom or greater and 39.9% by atom or less. The forgeability and the tensile strength of the alloy are improved as the content of Al is lower. However, the decrease in the content of Al leads to a relative increase in the content of Ti, which increases a specific gravity of the alloy to decrease the specific strength accordingly. In view of this, the content of Al is set to 38.0% to 39.9% by atom. The alloy including Al with the content of 38.0% by atom can ensure favorable specific strength. While a content of Al in an alloy composition provided with a lamellar structure having great high-temperature strength and toughness is in a range of 47% to 48% by atom, the upper limit of the content of Al in the TiAl alloy material for forging according to the present disclosure is set to 39.9% by atom that is lower than the above range. This is based on the design intended to have the composition having the advantage of stabilizing the β-phase in view of Al that is the α-phase stabilizing element. This composition leads the metallographic structure of the TiAl alloy material to contain grains of the lamellar structure and further contain TiAl grains (the γ-phase) and Ti grains (the β-phase) together. If the content of Al is greater than 39.9% by atom, the high-temperature forgeability of the TiAl alloy material is decreased, which impedes the forging at a high speed.

The elements, niobium (Nb) and vanadium (V), included in the TiAl alloy material are the β-phase stabilizing elements having a function of stabilizing the β-phase in the metallographic structure. The respective β-phase stabilizing elements, when used independently, are effective in decreasing the modification temperature, and can expand the existing region of the β-phase in the phase diagram toward the low temperature side. This improves high-temperature deformability during forging to enhance the processability. For this reason, the present disclosure uses Nb and V as the β-phase stabilizing elements. These elements stabilize the β-phase and improve the forgeability of the alloy. The use of both Nb and V can effectively decrease the peak stress in the TiAl alloy, so as to avoid a decrease in the processability due to the addition of carbon, while effectively enhancing the high-temperature deformability. The hot forging at a higher speed thus can be executed for the TiAl alloy. The respective added amounts of the elements Nb and V are preferably determined so that the total amount is set to 6.0% by atom or greater and 9.0% by atom or less. The decrease in the forging temperature may not be achieved because of an insufficient decrease in the modification temperature if the content in total is less than 6.0% by atom, while the mechanical strength of the alloy is decreased if the content in total exceeds 9.0% by atom.

The element Nb is effective in improving antioxidation and strength. The content of Nb in the TiAl alloy material for hot forging is preferably set to 3.0% by atom or greater and 5.0% by atom or less. Setting the content of Nb in this range can satisfactorily form the β-phase when heated upon the forging, and is also effective in the antioxidation. The content of Nb less than 3.0% by atom cannot sufficiently stabilize the β-phase, or may impede the improvement in the forgeability of the TiAl alloy. The content of Nb exceeding 5.0% by atom may cause segregation, and increases the specific gravity of the alloy.

The element V also has the β-phase stabilizing effect, as in the case of Nb, and improves the forgeability and enhances room-temperature ductility of the TiAl alloy. The content of V is preferably set to be substantially the same as the content of Nb, so as to achieve the improvement in the forgeability most effectively. The forgeability of the TiAl alloy cannot be improved sufficiently if the content of V is less than 3.0% by atom, while the strength of the TiAl alloy is decreased if the content of V exceeds 4.0% by atom.

The element, carbon (C), has the effects of increasing the creep strength and enhancing the high-temperature strength. To avoid a decrease in the forgeability, the content of carbon is preferably set to 0.05% by atom or greater and 0.15% by atom or less. The strength of the TiAl alloy cannot be improved sufficiently if the content of carbon is less than 0.05% by atom, while the forgeability of the TiAl alloy is decreased if the content of carbon exceeds 0.15% by atom. The effects due to the addition of carbon are effectively achieved when balanced together with Al, Nb, and V described above.

The element, boron (B), has a function of micronizing the crystalline grains produced in the metallographic structure and enhancing the ductility of the TiAl alloy. The addition of B increases the ductility of the TiAl alloy in a temperature range set to 1100° C. or higher, and remarkably increases the ductility particularly in a temperature range set to 1200° C. or higher. The element B, which has the effect of increasing the ductility at a high temperature, is effective in improving the hot forging. The addition of B together with Nb and V serving as the β-phase stabilizing elements exhibits the effects of decreasing the peak stress upon forging and also decreasing deformation resistance even at a high strain rate, and is thus effective in improving the forgeability. The combination of B with Nb and V thus has the advantage of exhibiting the high-speed forging.

The addition of B is optional. The content of B, when added to the alloy, is preferably set to 0.1% by atom or greater and 0.2% by atom or less. The effect due to the addition of B is remarkably ensured when the content of B is 0.1% by atom, and the crystalline grains produced in the constitution are further micronized to have a particle diameter of 200 μm or smaller as the content of B is increased. The particle diameter can be further reduced to 100 μm or smaller. The micronization of the crystalline grains improves the ductility of the TiAl alloy. The content of B is preferably set to 0.2% by atom or less, since a further reduction in the diameter of the crystalline grains cannot be expected or the toughness is decreased if the content exceeds 0.2% by atom. The content of B exceeding 1.0% by atom tends to cause a boride with a size of exceeding 100 μm during the preparation of the TiAl alloy material by casting, which decreases the ductility to decrease the forgeability accordingly. The boride in this case is TiB or $TiB_2$, for example, and is precipitated into a needle-like shape.

The addition of B with the content of 0.2% by atom or less can provide the fine structure in which the crystalline grains caused in the metallographic structure of the TiAl alloy material have the particle diameter of 200 μm or smaller. The boride is caused as grains included in such crystalline grains having a particle diameter of 100 μm or smaller. The micronization of the precipitated grains increases the ductility of the TiAl alloy, so as to improve the forgeability. The boride is finely precipitated as grains with the particle diameter of 100 μm or smaller in the crystalline grains in the metallographic structure in the TiAl alloy subjected to the forging and the heat treatment, so as to improve the mechanical strength of the TiAl alloy. The particle diameter of the crystalline grains as used herein refers to an area mean particle diameter converted by the areas of the crystalline grains by image analysis of the cross section of the metallographic structure.

The element Ti reacts with the air at a high temperature or a gas component in an atmosphere, and can contain impurities such as oxygen or nitrogen in association with surface oxidation or internal diffusion of the impurities. The element Al also can contain oxygen due to the surface oxidation. The TiAl alloy material for forging according to the present disclosure may include such inevitable impurities. For the manufacture of the TiAl alloy material for forging, the prevention of oxidation needs to be taken into consideration in an operating situation such as melting or casting using a raw material at a high temperature, since a deterioration in the properties of the alloy material due to contamination is preferably avoided.

A method of manufacturing the above TiAl alloy material for forging is described below.

The method of manufacturing the TiAl alloy material for forging includes a casting step of heating and melting a raw material having a composition entirely corresponding to the chemical composition of the TiAl alloy material as described above to cast the TiAl alloy material. The raw material may be in a state of any of powder, a metal piece, and a metal ingot, or may be in a combined state of two or more thereof. The powder state, the metal piece, and the metal ingot each may be either simple metal of the components included in the TiAl alloy material or an alloy of the plural constituent components. The raw material may be chosen as appropriate from a mixture of the simple metals, a mixture of the simple metal and the alloy, the alloy itself, and a mixture of the alloys. The raw material can be prepared with the combination of the respective components so as to entirely have the chemical composition of the TiAl alloy material as described above. Alternatively, a raw material preliminarily prepared to have the chemical composition as described above may be obtained and used. Carbon powder such as graphite may be used as carbon to be added. The carbon powder and the boron as a simple element, when used to prepare the raw material, need to be added while taking account of a loss and an error in measurement during the preparation.

The casting step includes melting processing of heating and melting the raw material prepared as described above, and molding processing of cooling the melted raw material to cast the material into an ingot having an intended shape. These processing steps can provide the material solidified from a molten state of the TiAl alloy having the chemical composition as described above to be used as the TiAl alloy material for forging. The casting is preferably executed by use of a melting technique and a casting technique as appropriate typically used for casting metallic materials. Examples of techniques include a vacuum arc melting-centrifugal casting method, a melting-casting method (a Levicast method), and a precision casting technique in which a crucible covered with a face coat and centrifugal casting are combined together. A device used in the casting step may be any device that can prevent an entry of impurities and a reaction such as oxidation, and may be a casting device such as a vacuum induction furnace, for example.

The material solidified from a molten state obtained by the casting may be subjected to hot isostatic pressing (HIP) treatment. The HIP treatment can avoid internal defects such as casting defects. The HIP treatment may use a HIP device typically used for processing metallic materials.

The method of manufacturing the TiAl alloy material for forging may further include surface processing of removing a casted surface (a surface layer) of the material solidified from a molten state of the TiAl alloy obtained by the casting step. This processing can avoid a decrease in the processability caused by an oxidation film on the surface, so as to provide the TiAl alloy material for forging having a fine surface condition. The surface processing may be executed by cutting or grinding, for example. When the TiAl alloy material externally manufactured is obtained and forged, the surface processing is preferably executed immediately before the forging step at the preparation stage in the hot forging method.

The TiAl alloy material for forging can be processed into a TiAl alloy forged body having an intended shape in accordance with the following hot forging method. In particular, the hot forging method for the TiAl alloy material includes a step of preparing the TiAl alloy material for hot forging having the chemical composition as described above, and a hot forging step of heating the TiAl alloy material for hot forging to a forging temperature in a non-oxidizing atmosphere, and executing the forging while keeping the forging temperature constant. The surface processing described above may be included in the step of preparing the TiAl alloy material for hot forging.

The forging temperature is set within a range of a phase equilibrium temperature in which the β-phase can be present in the phase diagram of the TiAl alloy, namely, in the range of the phase equilibrium temperature of either the β-phase or the (β+α) phase. In particular, the forging temperature is preferably set as follows with reference to the phase diagram of the TiAl alloy.

Figure 3:
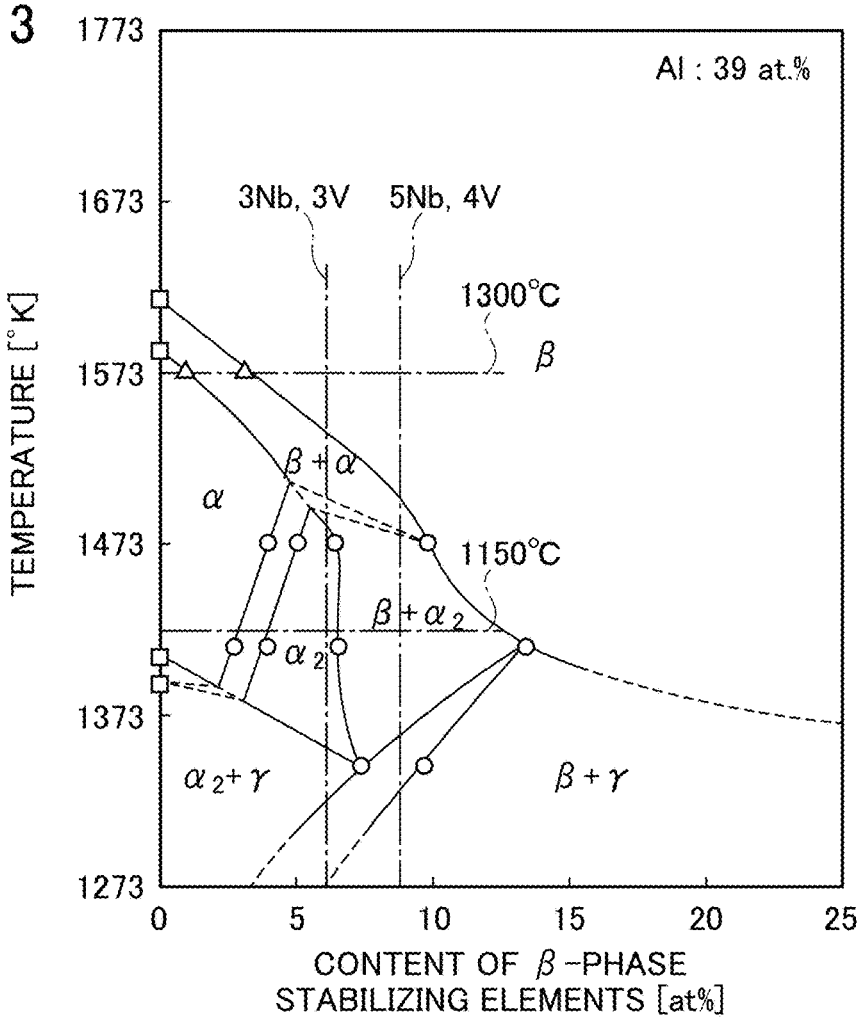
FIG. 3 is a phase diagram showing a phase equilibrium state depending on the content of β-phase stabilizing elements on the basis of a component of Ti-39% by atom of Al.

FIG. 3 is a phase diagram in which a relationship is examined between the content of the β-phase stabilizing elements (the sum [% by atom] of the contents of Nb and V) and the phase equilibrium state of the TiAl alloy on the basis of the composition of Ti-39% by atom of Al-0.1% by atom of C. When the alloy including the β-phase stabilizing elements with the content in the range of 6.0% to 9.0% by atom is heated so that the temperature is increased from the room temperature, the phase condition of the alloy is shifted to the β-phase through the (β+γ) phase, the ($\beta+\alpha_2$) phase, and the (β+α) phase. It is apparent from the phase diagram shown in FIG. 3 that the β-phase is present in the alloy to improve the forgeability at a temperature of 1150° C. (1423° K) or higher, and preferably at a temperature of 1200° C. (1473° K) or higher. The forging temperature thus can be set to 1150° C. or higher, and preferably set to 1200° C. or higher. While the upper limit of the forging temperature can be set in the range in which the β-phase can be present, the TiAl alloy material having the chemical composition as described above can be forged appropriately at a temperature of 1300° C. (1573° K) or lower. This temperature thus can be set as the upper limit in view of the durability for the forging device. The forging temperature can be set to about 1150° C. or higher and about 1300° C. or lower in accordance with the phase diagram, while keeping the TiAl alloy material at the temperature in this range to execute the isothermal forging.

The hot forging step is preferably executed in the non-oxidizing atmosphere to avoid oxidation. The non-oxidizing atmosphere may be an inert gas atmosphere such as argon gas, for example. The forging method may be chosen as appropriate from typical forging methods for metallic materials such as free forging, die forging, roll forging, and extrusion forging, and a forging device to be used may be chosen as appropriate in accordance with the forging method to be applied. The TiAl alloy material for hot forging according to the present disclosure can also be used for hot pressing or hot rolling. In the case of the die forging, the molding temperature is preferably set to about 700° C. or higher in view of keeping the temperature of the TiAl alloy material. The processing by the hot forging can be executed appropriately at a strain rate of about 0.1 per second or higher. Since the peak stress is small and the deformation resistance is low in the TiAl alloy material, the forging processing can be executed appropriately without causing forging breakage at a strain rate in a range of about 1 to 10 per second. This enables the high-speed forging at a forging speed of 2 spm (strokes per minute) or greater.

The TiAl alloy material heated to the forging temperature improves in the high-temperature ductility since the β-phase is present in the metallographic structure, so as to allow plastic deformation by the forging to advance smoothly. The forging decreases the casting defects in the TiAl alloy material, and splits the metallographic structure into the fine crystalline grains. The metallographic structure can be micronized finely as the processing degree during forging is larger. The forging processing is available in which an effective strain is in a range of about 0.5 to 1.

Since the chemical composition of the TiAl alloy material for hot forging is designed to lead the β-phase to be stabilized, the coarseness of the crystalline grains due to the growth of the α-phase is avoided by cooling after the forging. The cooling process may be made either in the forging device or by external air cooling. The metallographic structure of the titanium aluminide alloy forged body (the TiAl alloy forged body) obtained through the hot forging step includes the crystalline grains of the lamellar structure (the structure in which the $\alpha_2$-phase of about 20% by mass is precipitated in layers in the γ-phase), the β-phase, and the γ-phase, while the β-phase stabilizing elements and carbon are mixed to form a solid solution in Ti. When the TiAl alloy material includes boron, the fine boride is precipitated into a needle-like shape in the crystalline grains. The TiAl alloy forged body has the high creep strength due to the addition of carbon. The high-temperature strength of the TiAl alloy forged body can be improved by the following heat treatment executed as necessary.

The β-phase, which can be included in the metallographic structure of the TiAl alloy forged body, can be led to characteristic modification by heat treatment. Subjecting the forged body to heat treatment can reorganize the metallographic structure to modify the characteristics of the alloy. In particular, the heat treatment for producing the γ-phase can enhance the high-temperature strength. The proportion of the γ-phase is increased while the proportion of the β-phase is decreased in the metallographic structure of the forged body subjected to the heat treatment.

The method of forging the TiAl alloy material thus can further include the heat treatment made for the forged body obtained by the hot forging step. The heat treatment is preferably executed in the non-oxidizing atmosphere so as to avoid oxidation. Examples of the non-oxidizing atmosphere include an inert gas atmosphere such as argon gas, a vacuum atmosphere, and a reducing atmosphere such as hydrogen gas.

The heat treatment made for the TiAl alloy forged body preferably includes a first heat treatment step and a second heat treatment step. The first heat treatment step heats the TiAl alloy forged body obtained by the forging step to a temperature of 1220° C. or higher and 1240° C. or lower. The heating temperature is within the phase equilibrium temperature range of either the (β+α) phase or the (β+α+$\alpha_2$) phase in the phase diagram, and the TiAl alloy composing the forged body is led to be in the state in which the α-phase can be present.

The first heat treatment step only needs to be executed such that the internal temperature of the TiAl alloy forged body reaches about the temperature range described above. The treatment time in the first heat treatment step can be basically set to 15 minutes or longer, and practically set in a range of about one to five hours.

The forged body through the first heat treatment is preferably cooled before the second heat treatment so as to temporarily lower the temperature. The second heat treatment step leads the TiAl alloy forged body reaching a normal temperature through the first heat treatment step to be kept at a temperature of 900° C. or higher and 1000° C. or lower for one hour or longer. The heating temperature is preferably kept for one hour or longer and five hours or shorter. The TiAl alloy forged body through the second heating treatment is then cooled to around a room temperature.

The first heat treatment step relaxes a stress strain of the crystalline grains due to the forging to cause new crystalline grains without strain instead of the grains deformed by the strain. The α-phase generated in the TiAl alloy is then dispersed and precipitated as fine crystalline grains. The first heat treatment executed thus corresponds to a recrystallizing treatment. The second heat treatment step has an effect as an aging treatment that relaxes a strain in the crystalline grain boundary. In the second heat treatment step, the crystalline grains of the lamellar structure composed of the $\alpha_2$-phase and the γ-phase are generated from the α-phase. The second heat treatment step leads the TiAl alloy composing the forged body to have the metallographic structure having the crystalline grains of the lamellar structure, the crystalline grains of the γ-phase, and the crystalline grains of the β-phase.

When the TiAl alloy material has the chemical composition including boron, the fine boride is precipitated into a needle-like shape in the crystalline grains when the TiAl alloy forged body is subjected to the heat treatment. The TiAl alloy composing the forged body thus has the metallographic structure including the fine boride grains having a particle size of about 0.1 μm or smaller, in addition to the crystalline grains of the lamellar structure and the crystalline grains of the γ-phase and the β-phase. The boride grains are composed of TiB or $TiB_2$, for example.

As described above, the present disclosure can provide the TiAl alloy material for hot forging having the improved creep strength while avoiding a decrease in the processability of hot working so as to ensure both the processability and the strength due to the chemical composition that stabilizes the β-phase and the addition of carbon. The improvement in the high-temperature processability also enables the hot forging at a higher strain rate while avoiding forging breakage. While conventional isothermal forging for a TiAl alloy executes hot forging processing at a low strain rate in a range of about $5\times10^{-5}$ to $5\times10^{-1}$ per second, the TiAl alloy for forging according to the present disclosure can reduce the peak stress to a lower level. The forging thus can be executed at a strain rate of one per second or higher, or even the higher forging can be executed at a strain rate of 10 per second or higher, so as to improve the productivity of components such as turbine blades. The TiAl alloy material for forging thus can be effectively used as a forging material for manufacturing engine components for aircraft such as turbine blades by the hot forging.

Example 1

Preparation of TiAl Alloy Material for Forging

A TiAl alloy raw material was prepared for each of samples 1 and 2 having a chemical composition (by atom) listed below and melted in a high-frequency vacuum melting furnace to be poured to a die, and was then cooled to a normal temperature and casted, so as to prepare a sample of a TiAl alloy material for forging. The indication of inevitable impurities in each example is omitted below since the content thereof is quite small.

Sample 1: Ti-39.0 of Al-4.0 of Nb-3.5 of V-0.1 of C

Sample 2: Ti-44.7 of Al-3.7 of Nb-3.5 of V

Evaluation of Forgeability by Measurement of Peak Stress

The samples of the TiAl alloy material for forging (samples 1 to 2) conforming to a predetermined shape of the die were prepared as descried above as test pieces for a compression test. The following compression test was executed for the samples by use of the respective test pieces.

Figure 4:
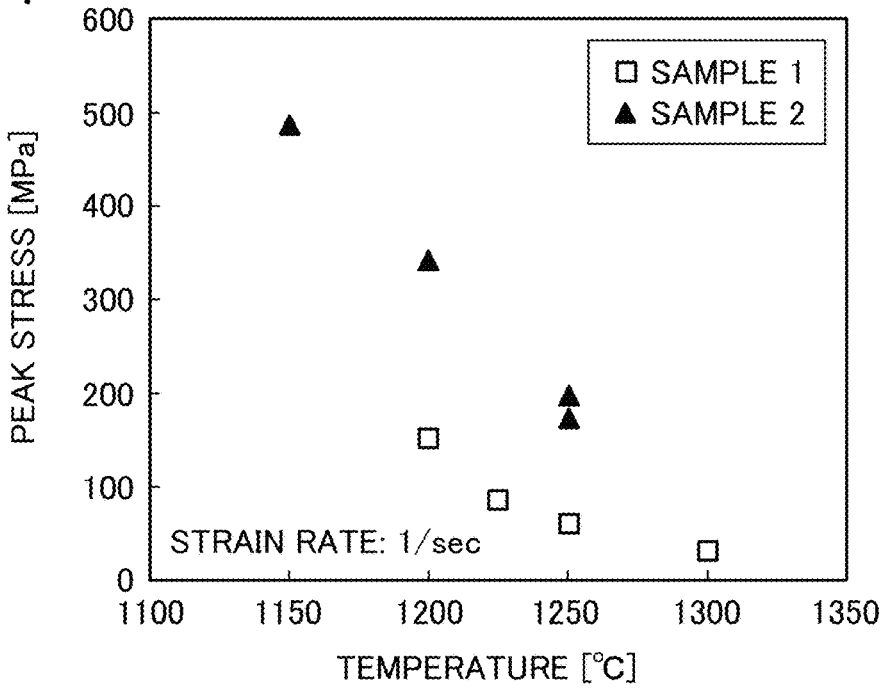
FIG. 4 is a graph showing a relationship between a temperature and a peak stress (a strain rate: 1/sec) in a TiAl alloy material for hot forging.

The temperature was kept constant in a range of 1150° C. to 1300° C., the respective test pieces each held between two parallel plate surfaces of a test device were applied with a load to be subjected to the compression test at a strain rate of each of 0.01 per second, 0.1 per second, 1 per second, and 10 per second so as to obtain a true stress-true strain curve up to true strain of 1.2. The maximum stress in this curve was acquired as a peak stress. The strain rate as used herein was a strain rate of true strain. The temperature was changed within the range as described above to repeat the compression test so as to obtain a relationship between the temperature and the peak stress. FIG. 4 shows the results.

Evaluation revealed as shown in FIG. 4 that the peak stress is remarkably low in the TiAl alloy material of sample 1, and the forgeability in sample 1 is much higher than sample 2. The peak stress in sample 1 corresponds to a value in sample 2 at a temperature increased by about 50° C. or more according to the results shown in FIG. 4. It can be considered that sample 1 can be forged at a lower temperature decreased by about 50° C. or more than sample 2, and the forging temperature can be set in the range of 1150° C. to 1300° C. The improvement in the forgeability described above is presumed to be derived from the composition in which the β-phase stabilizing elements are added while the content of Al is low.

Example 2

Preparation of TiAl Alloy Material Sample for Forging

A sample of a TiAl alloy material for forging was prepared as sample 1 by the same preparation method as Example 1. The TiAl alloy for forging was molded into a predetermined shape by use of the die in the sample preparation.

Hot Forging for TiAl Alloy Material

Figure 5:
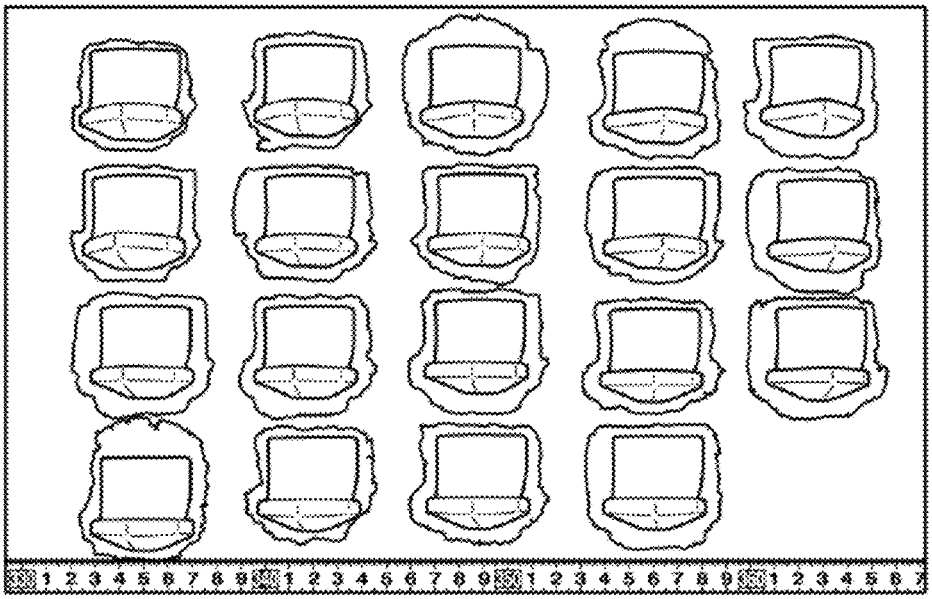
FIG. 5 is a captured image of a forged body of the TiAl alloy material subjected to hot forging.

The sample of the TiAl alloy material for forging thus obtained was heated in an inert atmosphere of argon gas to be kept at a temperature in a range of 1150° C. to 1175° C., and was then subjected to die press forging at a strain rate of one per second so as to be processed into a net shape of a product. The processing by the hot forging can be repeated several times satisfactorily without forging breakage caused, as shown in the photograph of FIG. 5.

The present disclosure can provide the TiAl alloy material for hot forging having the improved processability of hot working without impeding the creep strength, so as to be applied to the manufacture of components for engines for aircraft and rotor blades and discs of gas turbines for power generation, achieving the efficient provision of products due to the improvement in efficiency of manufacture accordingly. The present disclosure can also enhance the economic efficiency so as to contribute to the expansion of the applicable range of hot forging for the TiAl alloy material.

What is claimed is:

1. A titanium aluminide alloy material for hot forging having a chemical composition, comprising: aluminum of 38.0 atomic % or greater and 39.9 atomic % or less, niobium of 3.0 atomic % or greater and 5.0 atomic % or less, vanadium of 3.0 atomic % or greater and 4.0 atomic % or less, carbon of 0.05 atomic % or greater and 0.15 atomic % or less, and titanium and an inevitable impurity, wherein the titanium aluminide alloy material has a metallographic structure comprising crystalline grains of lamellar structure, crystalline grains of γ-phase, and crystalline grains of β-phase.

2. A titanium aluminide alloy material for hot forging having a chemical composition comprising: aluminum of 38.0 atomic % or greater and 39.9 atomic % or less, niobium of 3.0 atomic % or greater and 5.0 atomic % or less, vanadium of 3.0 atomic % or greater and 4.0 atomic % or less, carbon of 0.05 atomic % or greater and 0.15 atomic % or less, boron of 0.1 atomic % or greater and 0.2 atomic % or less, and titanium and an inevitable impurity, wherein the titanium aluminide alloy material has a metallographic structure comprising crystalline grains of lamellar structure, crystalline grains of γ-phase, and crystalline grains of β-phase.

3. A hot forging method for a titanium aluminide alloy material, the method comprising:

preparing the titanium aluminide alloy material for hot forging according to claim 1; and executing hot forging by setting a forging temperature within a range of a phase equilibrium temperature of either a β-phase or a (β+α) phase in a phase diagram of the titanium aluminide alloy material, and forging the titanium aluminide alloy material while keeping the set forging temperature in a non-oxidizing atmosphere.

4. The hot forging method for the titanium aluminide alloy material according to claim 3, wherein the forging temperature in the hot forging is set to 1150° C. or higher and 1300° C. or lower.

5. The hot forging method for the titanium aluminide alloy material according to claim 3, wherein a strain rate in the hot forging is 0.1 per second or higher.

6. The hot forging method for the titanium aluminide alloy material according to claim 3, wherein a strain rate in the hot forging is 1 per second or higher.

7. A hot forging method for a titanium aluminide alloy material, the method comprising:

preparing the titanium aluminide alloy material for hot forging according to claim 2; and executing hot forging by setting a forging temperature within a range of a phase equilibrium temperature of either a β-phase or a (B+α) phase in a phase diagram of the titanium aluminide alloy material, and forging the titanium aluminide alloy material while keeping the set forging temperature in a non-oxidizing atmosphere.

8. The titanium aluminide alloy material according to claim 1, wherein the crystalline grains have a particle diameter of 200 μm or smaller, and the particle diameter of the crystalline grains is an area mean particle diameter converted by areas of the crystalline grains by image analysis of a cross section of the metallographic structure.

9. The titanium aluminide alloy material according to claim 2, wherein the crystalline grains have a particle diameter of 200 μm or smaller, and the particle diameter of the crystalline grains is an area mean particle diameter converted by areas of the crystalline grains by image analysis of a cross section of the metallographic structure.

10. The titanium aluminide alloy material according to claim 1, wherein the lamellar structure is a structure in which an $\alpha_2$-phase is precipitated in layers in the γ-phase.

11. The titanium aluminide alloy material according to claim 2, wherein the lamellar structure is a structure in which an $\alpha_2$-phase is precipitated in layers in the γ-phase.

12. The titanium aluminide alloy material according to claim 1, wherein the niobium, vanadium and carbon are mixed to form a solid solution in the titanium.

13. The titanium aluminide alloy material according to claim 2, wherein the niobium, vanadium and carbon are mixed to form a solid solution in the titanium.

14. The titanium aluminide alloy material according to claim 2, wherein the metallographic structure further comprises boride grains having a particle size of 0.1 μm or smaller.

* * * * *